United States Patent [19]

Ishino et al.

[11] Patent Number: 4,995,247

[45] Date of Patent: Feb. 26, 1991

[54] WASHING MACHINE

[75] Inventors: Takashi Ishino; Isao Hiyama; Yousuke Nagano, all of Hitachi; Tamotu Shikamori, Ibaraki; Shizuo Turuta, Kitaibaraki; Toshiyasu Kamano; Hiroshi Ohsugi, both of Hitachi, all of Japan

[73] Assignee: Hitachi, Ltd., Tokyo, Japan

[21] Appl. No.: 434,470

[22] Filed: Nov. 14, 1989

Related U.S. Application Data

[60] Continuation of Ser. No. 228,128, Aug. 4, 1988, abandoned, which is a division of Ser. No. 84,218, Aug. 12, 1987, abandoned.

[30] Foreign Application Priority Data

Aug. 22, 1986 [JP] Japan ..... 61-19540

[51] Int. Cl.[5] ..... D06F 33/02; D06F 39/08

[52] U.S. Cl. ..... 68/12 R; 68/207

[58] Field of Search ..... 8/158, 159; 68/12 R, 68/148, 154, 174, 207, 133

[56] References Cited

U.S. PATENT DOCUMENTS

| | | | |
|---|---|---|---|
| 3,362,197 | 1/1968 | Reed | 68/207 X |
| 3,379,007 | 4/1968 | Brundage | 68/133 X |
| 4,631,771 | 12/1986 | Anderson et al. | 8/159 X |

FOREIGN PATENT DOCUMENTS

| | | | |
|---|---|---|---|
| 7411391 | 3/1976 | Netherlands | 8/158 |

*Primary Examiner*—Philip R. Coe

*Attorney, Agent, or Firm*—Antonelli, Terry, Stout & Kraus

[57] ABSTRACT

A washing machine is disclosed in which water is poured on the washing within a washing and dehydrating tank through a water supply port while turning the washing and dehydrating tank slowly, to thereby cause the water to sink into the washing before the normal washing thereof so as to reduce the bulk of the washing or prevent the floating of the washing. Thus, the regular agitating and washing of the washing are well performed.

4 Claims, 3 Drawing Sheets

WASHING MACHINE

CROSS REFERENCE TO RELATED APPLICATIONS

This application is a continuation application of U.S. application Ser. No. 228,128, filed Aug. 4, 1988, now abandoned, which is a continuation of U.S. application No. 84,218, filed Aug. 12, 1987, now U.S. Pat. No. 4,868,944.

BACKGROUND OF THE INVENTION

The present invention relates to a washing machine that is capable of thorough cleaning of dirty clothes in a short period of time.

One example of such a washing machine has been proposed in Japanese Patent Unexamined Publication No. 75089/1985. This washing machine is constructed so that, in an initial half stage of the washing process, the washing is carried out with the washing water of a high concentration detergent having a level lower than a rated standard level, whereas in the final half stage of the washing process, the washing is carried out with the washing water of a standard concentration detergent after having supplied water up to the rated standard level.

However, this washing machine suffers from the following disadvantages. Namely, since the washing is carried out at the water level lower than the rated standard level in the initial half washing stage, the washing would be insufficient. There is a tendency that upper side clothes in the machine would not be soaked in the washing liquid, and the washing would be carried out without any replacement of the upper side clothes with lower side clothes. There would be a non-uniformity in washing the upper and lower clothes, and there would also be an entanglement of the clothes. Since the washing is carried out in the washing water of the high concentration detergent, there is a higher tendency that the clothes would be washed non-uniformly.

Also, in the water supply transient state between the initial half stage and the final half stage, the washing operation pauses. This pause period is about one minute. In order to reduce a washing time, it is necessary to effectively use this pause time for washing.

SUMMARY OF THE INVENTION

Accordingly, in view of the above-noted defects inherent in the conventional washing machine, an object of the present invention is to provide a washing machine in which clothes, to be washed, disposed into a washing/dehydrating tank of the machine are uniformly supplied with water so that the clothes are sunk into the washing/dehydrating tank, thereby preventing the floating of the clothes.

Another object of the present invention is to provide a washing machine in which the washing operation is continued even during the additional water supply, thereby reducing a washing time.

According to a first feature of the present invention, water is supplied to or poured on the washing or clothes to be washed while the washing and dehydrating tank is being turned slowly, thereby sinking the clothes in the washing/dehydrating tank without the floating of the clothes.

According to another significant feature of the invention, before a normal washing stage at a rated standard water level, there is provided a water supply and agitation process in which agitating vanes are actuated while additionally supplying water from a low water level of the high concentration detergent liquid to the rated standard water level.

BRIEF DESCRIPTION OF THE DRAWINGS

The accompanying drawings showing embodiments of the invention, in which.

DESCRIPTION OF THE PREFERRED EMBODIMENTS

The present invention will now be described with reference to the accompanying drawings. A first embodiment will be described in conjunction with FIGS. 1 to 4.

Figure 1:
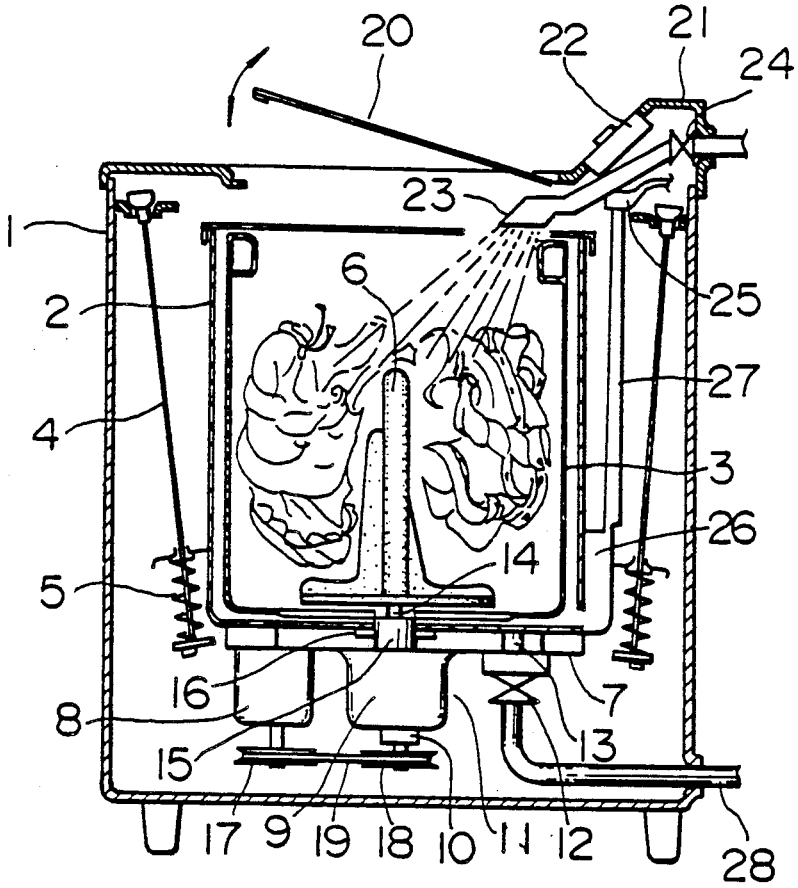
FIG. 1 is a schematic view showing a fully automatic washing machine as a whole.

FIG. 1 is a schematical view showing a fully automatic washing machine of the one-tank type. An outer frame 1 has a water receiving tank 2 in its interior. A washing/dehydrating tank 3 is rotatably provided within the water receiving tank 2. The water receiving tank 2 is supported through suspension rods 4 and springs 5 by the outer frame 1.

An agitating vane unit 6 is rotatably supported within the washing/dehydrating tank 3. A lower base 7 is mounted on a bottom of the water receiving tank 2. Primary power transmission means 11 including a driving source such as a motor 8, a power transmission mechanism 9 and a clutch portion 10 is mounted on the lower base 7. Also, a water discharge valve 12 is mounted on the lower base 7. The water discharge valve 12 is in communication with a bottom portion of the water receiving tank 2 through a water discharge port 13.

On the upper side of the primary transmission means 11, there are provided with a drive shaft 14 for the agitating vane unit 6 and a drive hollow shaft 15 for the washing/dehydrating tank 3. A seal portion 16 is used to seal a gap between the drive hollow shaft 15 and the water receiving tank 2.

A belt 19 is laid around a pulley 17 of the motor 8 and a pulley 18 of the power transmission mechanism 9.

A rotational power or torque of the motor 8 is transmitted through the pulley 17, the belt 19, the pulley 18, the clutch portion 10, the drive power transmission mechanism 9 and the drive shaft 14 to the agitating vane unit 6. The drive power is transmitted to the washing-/dehydrating tank 3 in the same manner as in the agitating unit 6 except for the drive hollow shaft 15 downstream of the drive power transmission mechanism 9.

A lid 20 is provided at the upper portion of the outer frame 1. A control device 22 including a timer switch is provided on an operating panel 21. The control device 22 comprises an electronic control having a microprocessor.

A water supply port 23 is provided above the washing/dehydrating tank 3. It is preferable to use as the water supply port 23 a tap which causes water to be supplied to the washing/dehydrating tank 3 like a shower. A water supply valve 24 serves to control the water supply or stop to the water supply port 23.

A pressure switch 25 for detecting a water level in the washing/dehydrating tank 3 is in communication through a tube 27 with an air trap 26 provided on the lower side of the water receiving tank 2. A water discharge hose 28 is coupled to the water discharge valve 12.

The operation controls such as a motor 8 control, a control of a drive magnet (not shown) for actuating the clutch portion 10, a control of a drive magnet (not shown) for actuating the water supply valve 24, a control of a drive compact motor (not shown) for actuating the water discharge valve 12, and a control of a drive magnet (that may serve to control the drive magnet of the clutch portion) for controlling a brake of the washing/dehydrating tank are, respectively, controlled by a program of the control device 22.

Figure 3:
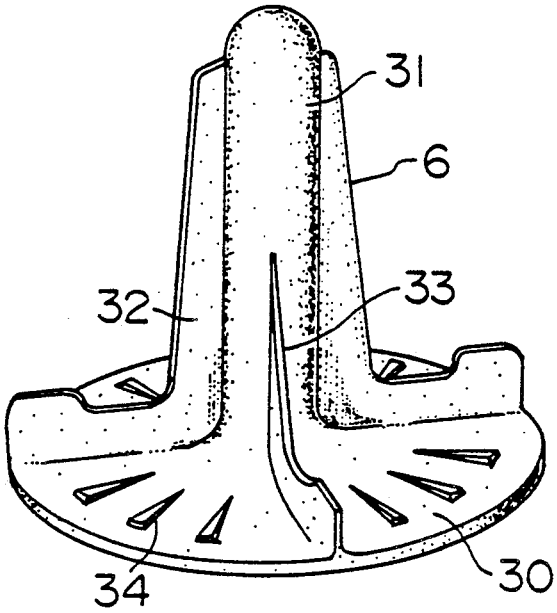
FIG. 3 is an enlarged perspective view showing an agitating vane unit of the machine of FIG. 1.

FIG. 3 shows a detail of the structure of the agitating vane unit 6.

In the agitating unit 6, a cylindrical post 31 is centrally formed on a disc-shaped base plate 30. A pair of primary vanes 32 are formed oppositely from the outer periphery of the base plate 30 to the upper end of the post 31. Further, a pair of auxiliary vanes 33 are formed also oppositely from the outer periphery of the base plate 30 to half the post 31. The auxiliary vanes 32 are formed between the two primary vanes 32, respectively. The primary vanes 32 and the auxiliary vanes 33 are alternatively formed at a pitch of 90°. The primary vanes 32 and the auxiliary vanes 33 have the same height over the base plate 30 and are raised at the outer circumferential portion of the base plate 30. Three small projection vanes 34 are equiangularly provided between each adjacent primary vane 32 and auxiliary vane 33 on the base plate 30.

Figure 4:
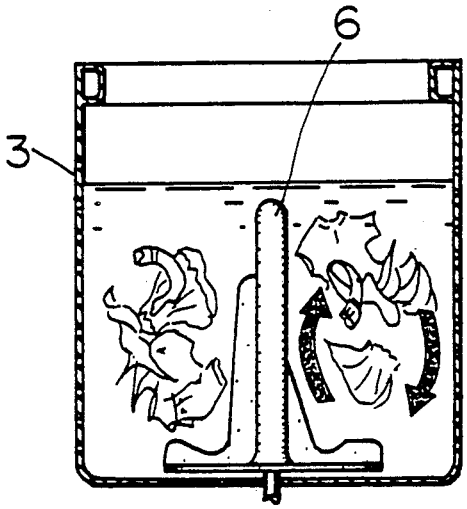
FIG. 4 is a view showing a behavior of the clothes during the washing in the machine of FIG. 1.

FIG. 4 shows a behavior of the washing during the operation of the agitating vane unit 6.

When the agitating vane unit 6 is operated at a short cycle alternatively in a forward direction and a reverse direction, the clothes to be washed are in a slippage frictional motion within the washing/dehydrating tank 3. The clothes are drawn toward the central portion of the agitating vane unit 6 by the action of the raised vane portions of the outer sections of the primary vanes 32 and the auxiliary vanes 33. At the same time, the clothes are urged radially outwardly by the action of the portions of the primary vanes 32 along the post 31. With such and outward movement, the clothes are repeatedly subjected to slippage and friction to be urged upwardly. The large arrows in FIG. 4 indicate the motion of the clothes. During this motion, the clothes are subjected to friction by the small projections 34 of the base plate 30 to be thoroughly washed. Even in the washing water at a low level, the up-and-down replacement of the clothes is well performed while the clothes are thoroughly washed.

Figure 2:
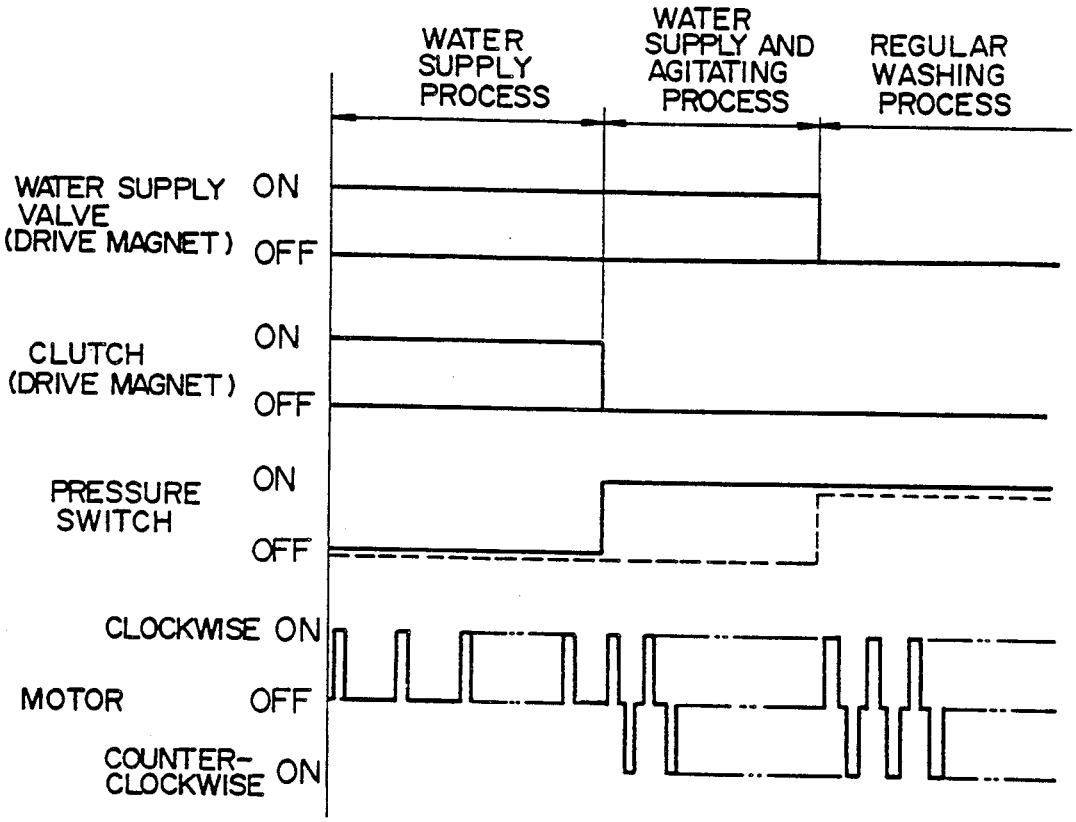
FIG. 2 is a time chart showing an operational program from a water supply process to a washing process of the machine of FIG. 1.

FIG. 2 shows the operational process from the water supply to the washing which constitutes the characterizing feature of the invention.

The drive operational magnet is actuated to turn the water supply valve 24 on, thereby advancing the water supply. A period of the water supply is about 1.8 minutes. Since the flow rate of water through a water service pipe of a normal water pressure is about 20 l/min, a water quantity of 35 l will be supplied to the washing/dehydrating tank 3. In a washing machine having a washing capacity of 4 kg, the necessary water quantity is 50 l. The water supply quantity of 35 l is about two thirds of the rated standard water level of 50 l.

During the above water supply process the motor 8 is operated intermittently in the forward or clockwise direction. The operating period (ON) is 0.6 seconds and the rest period (OFF) is 0.3 seconds. The brake of the washing/dehydrating tank 3 has been released by turning on the clutch portion 10 by means of the drive operational magnet, and the washing/dehydrating tank 3 is intermittently turned in the forward direction. Namely, the water is supplied from above while the washing/dehydrating tank 3 is being rotated slowly, and thus the clothes are kept under the condition that the waste is uniformly sprinkled or poured on the clothes. The detergent laid over the clothes is uniformly soluble, and the clothes are naturally sunk toward the bottom of the washing/dehydrating tank 3 while absorbing water, thus reducing the bulk of the washing and preventing the floating of the clothes (floating preventing process).

Thus, the clothes are uniformly soaked into the washing water with detergent. This leads to an advantage that a so-called soak washing is possible and a next agitating washing of the agitating vane unit 6 is better carried out. Because of the soak washing in the washing water of a high concentration detergent having the water level of two thirds of the rated standard water level, a persistent dirt will be well cleaned. Incidentally, the final water supply quantity in the water supply process may be about half the rated standard water level.

When the water in the washing/dehydrating tank reaches two thirds of the rated standard water level, the pressure switch 25 is turned on to thereby complete the water supply process. Although the period of the water supply is 1.8 minutes as described before, a longer time is needed for turning on the pressure switch 25 in the case where the pressure of the water service pipe is low. In the case of a extremely low water pipe pressure, the control device 22 is operated to stop the program for washing operation. In such a case, the washing is prevented as the water abnormal condition.

When the pressure switch 25 is turned on and its signal is inputted into the control device 22, the next step, that is, the water supply and washing process (water supply and agitating process) is started. The water supply valve 24 is kept being turned on following the previous water supply process, and the water is additionally supplied. When the water level reaches the rated standard water level of 50 l, the additional water quantity of 15 l has been supplied. Normally, it takes about 40 seconds to reach the rated standard water level.

During this period of 40 seconds, the agitating unit 6 undergoes the agitating operation. Namely, when the water reaches the two thirds of the rated standard water level, the pressure switch 25 is turned on so that the drive magnet is operated to turn off the clutch portion 10. The brake of the washing/dehydrating tank 3 is operated to be applied, and the motor 8 is alternatively operated in the clockwise or forward direction and in the counterclockwise or reverse direction. The operating time (ON time) in each of the forward and reverse directions is kept at 0.7 to 0.8 seconds. The OFF time is 0.3 seconds. Thus, the agitating vane unit 6 is rotated at such a short cycle in the forward and reverse directions. During the additional water supply, the agitating vane unit 6 is kept agitating without any rest to perform the water supply and agitating process. Thus, it is possible to reduce a period of time for the overall washing. Namely, after the water supply and agitating process, a regular normal washing process is carried out with the washing water kept at the rated standard water level. This normal washing process may be reduced. It takes about 7 minutes for the normal washing process. If the water supply and agitating process would not be available, it would take about 8 to 9 minutes for the normal washing process. Therefore, it is possible to reduce the washing time period by about 1 to 2 minutes.

The reduction of the period will be explained in view of various aspects of the washing.

The clothes are not necessarily soaked uniformly into the washing water by supplying water while turning the washing/dehydrating tank 3 slowly. Accordingly, in the case where the water is supplied up to the level corresponding to two thirds of the rated standard water level without rotating the washing/dehydrating tank 3, the clothes soaked in the washing water with detergent are considerably small. Even if the water is additionally supplied to the rated standard water level, the soaked condition is not so improved. This means that in the starting condition for the normal washing process after the additional water supply, the clothes are not uniformly soaked in the washing water. Accordingly, in the initial stage of the normal washing process, the clothes as a whole are not kept under the regular washing condition. When the initial agitation is performed, the clothes as a whole come at last to be dipped into the washing water. This washing process thus involves a loss disadvantageously.

Contrarily, when the agitating vane unit 6 undergoes the agitation during the additional water supply up to the rated standard water level, the clothes are subjected to the radial motion as well as the up-and-down replacement effect. Under such a condition, the clothes are poured on or sprinkled with additional water from above, so as to be subjected to the bulk reducing or floating preventing effect such that the clothes further absorb the water to sink downwardly. For this reason, the up-and-down replacement and the radial motion of the clothes are further developed. Thus, in spite of the small water quantity less than the rated standard water level, the washing is well performed. When the water reaches the rated standard water level, a preliminary washing has been performed. Additionally, the clothes are subjected to a sufficient floating preventing effect to be soaked uniformly in the washing water. Thus, the clothes as a whole are subjected to the regular washing from the start of the normal washing process.

Also, the washing under the rated standard water level is suitable for cleaning a persistent dirt because of its high concentration detergent. The normal washing process after the water supply and agitating process is a regular agitating washing at the above-described rated standard water level with the standard concentration detergent. During this washing process, the motor is repeatedly operated among the forward rotation mode, the rest mode and the reverse rotation mode. The ON time of the forward rotation and reverse rotation is 0.7 to 0.8 seconds, and the OFF time of the rest mode is 0.3 seconds.

The transition from the water supply and agitating process to the normal washing process is performed by inputting the ON signal of the pressure switch 25 into the control device 22. Also, the transition from the water supply process to the water supply and agitating process is performed in accordance with the ON signal of the pressure switch 25, but these ON signals are different from each other. Namely, the ON signal of the pressure switch 25 for the transition to the water supply and agitating process is a low water level ON signal but the ON signal of the pressure switch 25 for the transition to the normal washing process is a rated standard water level ON signal.

After the normal washing process for a period of 7 minutes, processes such as discharge of washing water and dehydration are performed.

Figure 5:
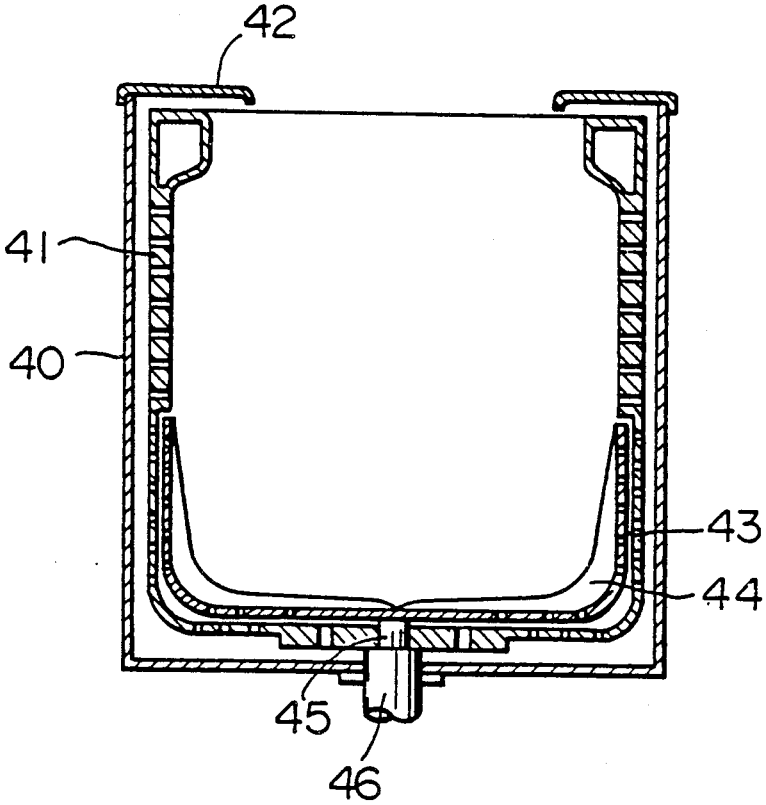
FIG. 5 is a cross-sectional view showing an essential part, of a washing machine having a bottomed cylindrical agitating vane unit in accordance with another embodiment.

The foregoing embodiment is related to the washing machine having a so-called agitator (agitating vane unit). However, the present invention is applicable to washing machines having a bottomed cylindrical agitator vane unit as shown in FIG. 5 or having a large size pulsator type agitating vane unit to ensure the same effects and advantages.

Explanation will be made as to the washing machine shown in FIG. 5. A washing/dehydrating tank 41 is rotatably, provided within a water receiving tank 40. A water splash preventing flange 42 is provided at an upper end of the water receiving tank 40. A bottomed cylindrical agitator vane unit 43 is rotatably mounted within the washing/dehydrating water tank 41. A plurality of vanes 44 are provided on an inside wall of the agitator vane unit 43.

A rotary shaft 45 is used to drivingly couple the agitator vane unit 43 to a drive source (not shown). A hollow rotary shaft 46 is used to drivingly couple the washing-/dehydrating tank 41 to a drive source (not shown).

The washing is performed by agitating the agitator vane unit 43 by means of the drive source. The agitator vane unit 43 is rotated at a high speed in one direction as well as the washing/dehydrating tank 41, thereby performing the dehydration of washed clothes. Also in this washing machine, the like washing may be performed by the operation according to the program as in the foregoing embodiment.

The foregoing description has been made as to a so-called fully automatic washing machine having the washing/dehydrating tank by way of example, but it is apparent for those skilled in the art that the present invention may be applied to a two-tank type washing machine having individually a washing tank and a dehydrating tank.

We claim:

1. A washing machine comprising a washing tank, an agitating vane unit rotatably mounted in the washing tank, motor means for driving the agitating vane unit, means including water supply valves means for supplying water to the washing tank, pressure switch means for detecting a water level in the washing tank and providing output signals respectively representing a rated standard water level and a fixed water level less than the rated standard water level, control means for providing operating instructions to said motor means and said water supply valve means in response to the output signal from said pressure switch detecting means, said control means being adapted to maintain the water supply valve means in a continuously open position while instructing said motor means to operate said agitating unit to wash and agitate upon receipt of the output signal representing the fixed water level less than the rated standard water level and to close the water supply valve means upon receipt of the output signal representing the rated standard water level while instructing said motor means to continue operating the agitating vane unit.

2. The washing machine as claimed in claim 1, wherein the water supply valve means is arranged so as to enable the to be sprinkled from above and over the wash.

3. The washing machine as claimed in claim 1, wherein said control means controls the agitating vane unit so as to operate the same at a short cycle alternatively in a forward direction and a reverse direction.

4. The washing machine according to claim 1, wherein the fixed water level is in a range of one-third to one-half of the rated standard water level.

* * * * *

UNITED STATES PATENT AND TRADEMARK OFFICE

CERTIFICATE OF CORRECTION

PATENT NO. : 4,995,247

DATED : February 26, 1991

INVENTOR(S) : T. ISHINO et al.

It is certified that error appears in the above-identified patent and that said Letters Patent is hereby corrected as shown below:

On the title page, item [30]
Foreign Application Priority DATA should read:

August 22, 1986 [JP] Japan.....61-195406

Signed and Sealed this

Twenty-third Day of May, 1995

Bruce Lehman

*Attest:*

BRUCE LEHMAN

*Attesting Officer*

*Commissioner of Patents and Trademarks*